US011454377B2

(12) United States Patent
Xue

(10) Patent No.: US 11,454,377 B2
(45) Date of Patent: Sep. 27, 2022

(54) LUMINAIRE BODY, FACE RING AND LIGHTING DEVICE

(71) Applicants: OPPLE LIGHTING CO., LTD., Shanghai (CN); SUZHOU OPPLE LIGHTING CO., LTD., Suzhou (CN)

(72) Inventor: Yong Xue, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/374,951

(22) Filed: Jul. 13, 2021

(65) Prior Publication Data

US 2021/0341133 A1 Nov. 4, 2021

Related U.S. Application Data

(63) Continuation of application No. PCT/CN2019/130411, filed on Dec. 31, 2019.

(51) Int. Cl.

| | |
|---|---|
| ***F21V 17/02*** | (2006.01) |
| ***F21V 19/02*** | (2006.01) |
| ***F21V 17/16*** | (2006.01) |

(52) U.S. Cl.

CPC ..... *F21V 17/02* (2013.01); *F21V 19/02* (2013.01); *F21V 17/16* (2013.01)

(58) Field of Classification Search

CPC ..... F21V 17/02; F21V 19/02; F21V 17/16; F21V 17/04; F21V 17/06; F21V 17/10; F21V 17/164; F21V 21/02; F21V 21/03; F21V 21/04

USPC ..... 362/364, 365, 366, 147, 148, 150

See application file for complete search history.

(56) References Cited

U.S. PATENT DOCUMENTS

2004/0252508 A1 12/2004 Lin

FOREIGN PATENT DOCUMENTS

| | | | | |
|---|---|---|---|---|
| CN | 206036692 U | | 3/2017 | |
| CN | 207334410 U | | 5/2018 | |
| CN | 208558987 U | | 3/2019 | |
| CN | 209245846 U | | 8/2019 | |
| CN | 209445303 U | | 9/2019 | |
| EP | 3153767 A1 | * | 4/2017 | ..... F21V 21/30 |

OTHER PUBLICATIONS

Search translation of CP 209245846. (Year: 2019).*
Search translation of CP 209445303. (Year: 2019).*
Search translation of CP 207334410. (Year: 2018).*
International Search Report of PCT Application No. PCT/CN2019/130411 dated Mar. 26, 2020 with English translation, (4p).

* cited by examiner

*Primary Examiner* — Laura K Tso
(74) *Attorney, Agent, or Firm* — Arch & Lake LLP

(57) ABSTRACT

The present disclosure discloses a luminaire body, a face ring and a lighting device. The luminaire body includes: a lamp, and at least one rotating shaft disposed on a sidewall of the lamp. The rotating shaft includes an elastic mechanism. One end of the elastic mechanism serves as a connection end which is disposed on the sidewall of the lamp. At least one first rabbet is provided in the elastic mechanism in a direction away from the connection end.

20 Claims, 9 Drawing Sheets

LUMINAIRE BODY, FACE RING AND LIGHTING DEVICE

CROSS REFERENCE TO RELATED APPLICATIONS

This application is based upon and claims the priority of PCT patent application No. PCT/CN2019/130411 filed on Dec. 31, 2019 which claims priority of Chinese Patent Application No. 201920057937.0 filed on Jan. 14, 2019, and Chinese Patent Application No. 201920428616.7 filed on Mar. 29, 2019, the entire disclosures of these applications are incorporated herein by reference in their entirety for all purposes.

TECHNICAL FIELD

The present disclosure relates to the technical field of lighting, and in particular, to a luminaire body, a face ring and a lighting device including the luminaire body and the face ring.

BACKGROUND

To improve the beauty and neatness of a lighting device, a face ring is sometimes mounted on a light-exiting end face of a luminaire body. The material, the surface treatment process and the size of the face ring may have influence on the overall beauty and neatness of the lighting device. Therefore, a luminaire body may be attached with different face rings depending on the installation environment.

SUMMARY

The present disclosure provides a luminaire body, a face ring and a lamp housing assembly.

In a first aspect, an example of the present disclosure provides a luminaire body, including: a lamp, and at least one rotating shaft disposed on a sidewall of the lamp. One end of the elastic mechanism serves as a connection end which is disposed on the sidewall of the lamp. At least one first rabbet is provided in the elastic mechanism in a direction away from the connection end.

In a second aspect, the present disclosure provides a face ring having one end configured to be sleeved on the luminaire body as described above and the other end configured to be fixed to a mounting face. The face ring includes: a face ring body and an inner ring surface. The inner ring surface has a circular ring structure protruding from the face ring body in a direction away from the mounting face, and the inner ring surface and the face ring body form a holding part for mounting the luminaire body. At least one connection unit is disposed on an outer wall of the inner ring surface, and the connection unit is configured to be connected to the rotating shaft.

In a third aspect, the present disclosure provides a lamp housing assembly including: a face ring having a first mounting space therein, two first sliding faces are formed opposite to each other on an outer surface of the face ring, and a second mounting space is provided on the first sliding face; and a housing disposed in the first mounting space. Two rotating shafts connected to the housing, and each rotating shaft is in running fit with the corresponding second mounting space. An adjusting block is disposed on each of the rotating shafts. The adjusting block presses against the corresponding first sliding face.

It is to be understood that both the foregoing general description and the following detailed description are exemplary and explanatory only and are not restrictive of the present disclosure.

BRIEF DESCRIPTION OF THE DRAWINGS

The drawings described here are used for providing a further understanding of the present disclosure, and constitute a part of the present disclosure. The exemplary examples of the present disclosure and descriptions thereof are intended to be illustrative of the present disclosure and do not constitute an undue limitation of the present disclosure. In the drawings.

DETAILED DESCRIPTION

Figure 1:
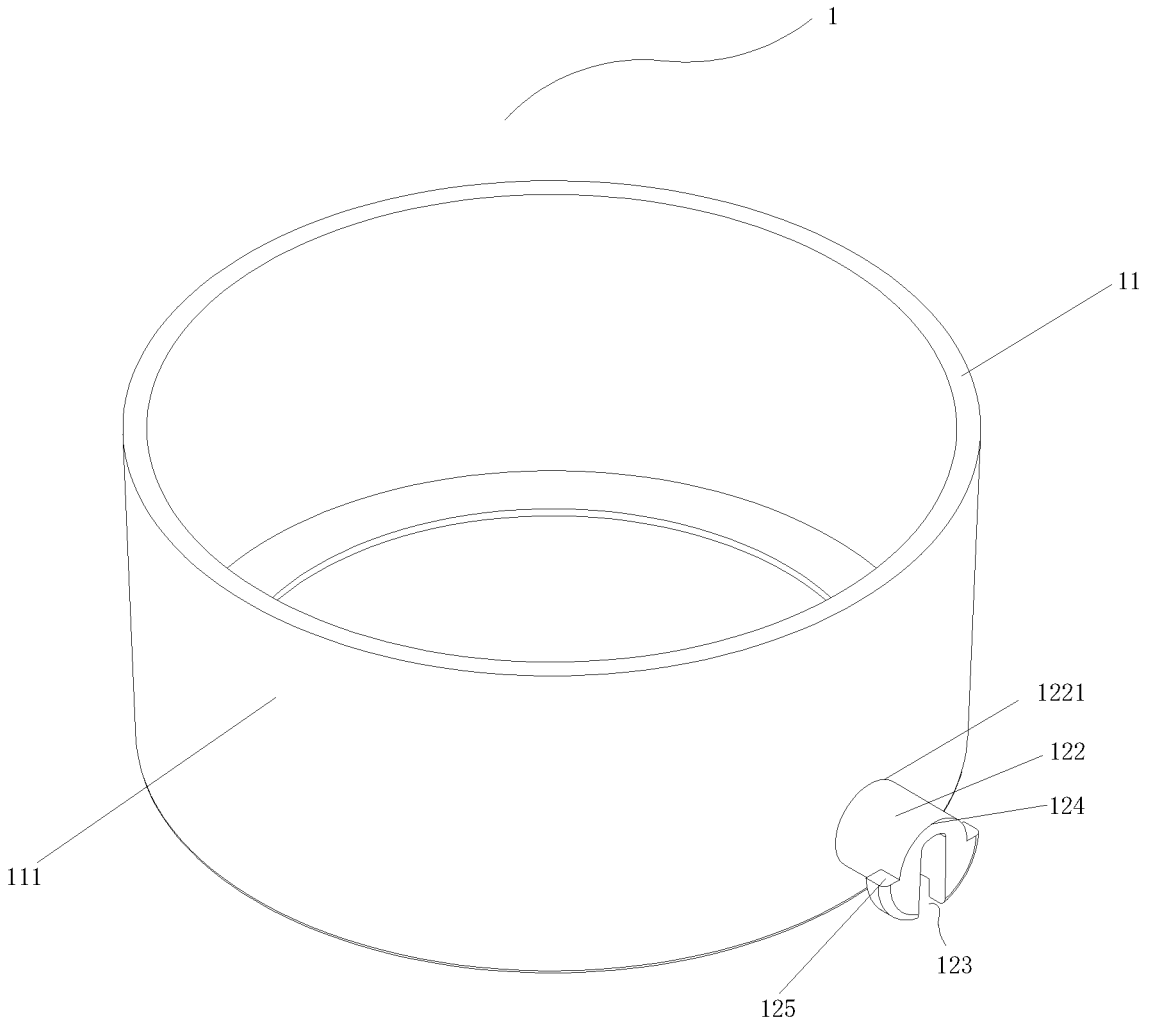
FIG. 1 is a schematic structure diagram of a luminaire body according to an example of the present disclosure.

To make the objects, technical solutions, and advantages of the present disclosure clearer, the technical solutions of the present disclosure will be described below clearly and completely in conjunction with specific examples of the present disclosure and the drawings. Apparently, the described examples are only a part of, not all of, the examples of the present disclosure. All other examples obtained by those of ordinary skill in the art based on the examples of the present disclosure without creative efforts shall fall within the protection scope of the present disclosure.

Reference Numerals used in this disclosure may include: 1—luminaire body, 11—lamp, 111—Sidewall, 12—rotating shaft, 121—mounting part, 122—elastic mechanism, 1221—connection end, 123—first rabbet, 1231—open end of C-shaped rabbet, 1232—closed end of C-shaped rabbet, 1233—circular rabbet, 1234—groove, 124—proximal end, 125—first limiting unit, 126—second limiting unit, 2—face ring, 21—face ring body, 22—inner ring surface, 221—end face, 23—holding part, 24—connection unit, 241—clamping part, 2411—inner wall, 2412—inclined guide face, 2413—transition face, 242—mating hole, 243—spring mounting groove, 25—second rabbet, 3—mounting face, 10—housing, 110—mounting cavity, 120—elastic body, 1210—adjusting block, 1211—second guide face, 1212—protrusion, 12121—second sliding face, 1220—rotating shaft, 13—housing mounting end, 20—face ring, 210—first mounting space, 220—second mounting space, 2210—first end, 222—second end, 230—first sliding face, 240—guide block, 2410—first guide face, 250—tubular body, 251—first tubular end, 252—second tubular end, and 26—annular body.

To achieve reliable connection between a luminaire body and a face ring, they are sometimes fastened to each other by using screws. Fastening with screws has the problem of time-consuming locking of screws and may lead to be unable to achieve fast mounting, dismounting and replacement of the luminaire body and the face ring.

Light Emitting Diode (LED) lighting devices are used in indoor illumination, including LED spot lamps. An LED spot lamp may include a light-emitting assembly, a lamp housing, and a face ring. The light-emitting assembly may include a lamp and may be mounted in the lamp housing. The face ring may have a mounting space therein. The face ring may be placed around the lamp housing, and the lamp housing can swing by a particular angle in the mounting space. When there is a need to adjust the irradiation angle of the LED spot lamp, the lamp housing may be rotated to adjust the irradiation angle of the LED spot lamp.

With regard to a spot lamp to be mounted on a ceiling, according to existing connection manner between the lamp housing and the face ring, the lamp housing and the face ring of the spot lamp are connected by means of an interference fit between a rotating shaft disposed on the lamp housing and a shaft hole formed in the face ring. An existing face ring may be made of a plastic material which has certain elastic deformation capacity. Thus, even though the rotating shaft of the lamp housing is in interference fit with the shaft hole of the face ring, the rotating shaft of the lamp housing can rotate in the shaft hole of the face ring, and there is a damping force between the rotating shaft of the lamp housing and the shaft hole of the face ring, which can keep the lamp housing in the adjusted position without swinging after the angle of the lamp housing is adjusted.

The material of a face ring would be an important factor for a customer to choose a commercially available LED spot lamp. Usually, metal face rings are more popular. However, the existing connection manner of a lamp housing and a face ring requires the face ring to have certain elastic deformation capability. That is, in view of the existing connection manner of a lamp housing and a face ring, the face ring cannot be made of a hard material such as a metal.

Sometimes, to achieve reliable connection between a luminaire body 1 and a face ring 2, they are typically fastened to each other by using screws. Fastening with screws has the problem of time-consuming locking of screws and may lead to be unable to achieve fast mounting, dismounting and replacement of the luminaire body 1 and the face ring 2.

To solve the above-mentioned problems, as shown in FIG. 1, an example of the present disclosure provides a luminaire body 1, including: a lamp 11, and at least one rotating shaft 12 disposed on a sidewall 111 of the lamp 11. The rotating shaft 12 includes an elastic mechanism 122. One end of the elastic mechanism 122 serves as a connection end 1221 which is disposed on the sidewall 111 of lamp 11. At least one first rabbet 123 is formed in the elastic mechanism 122 in a direction away from the connection end 1221. The luminaire body 1 may be designed into an integrated structure or a split structure, and the former may have the advantages of simple process and low cost.

Figure 2:
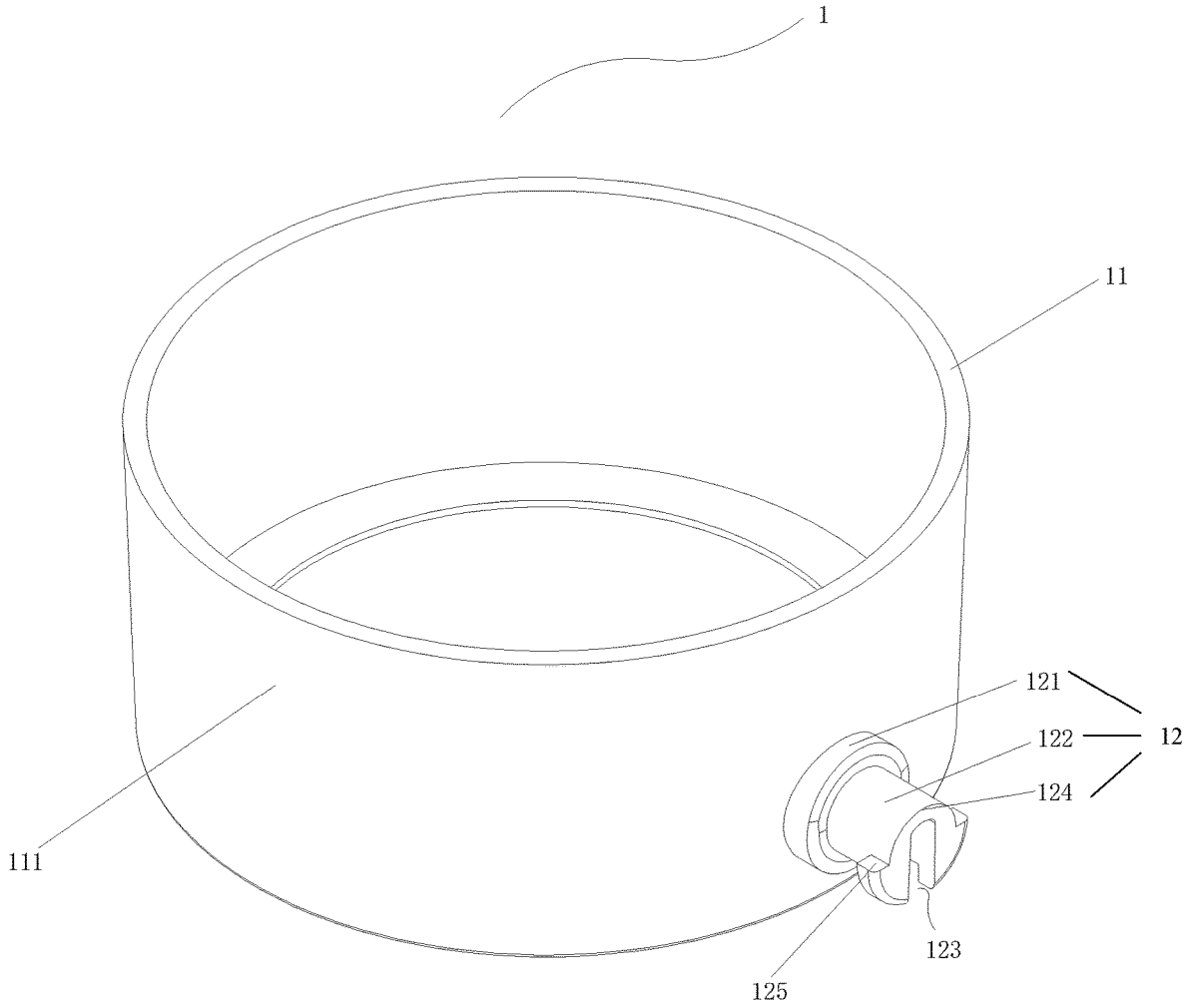
FIG. 2 is a schematic structure diagram of a luminaire body according to another example of the present disclosure.

As shown in FIG. 2, in one example of the present disclosure, the rotating shaft 12 further includes a mounting part 121. The mounting part 121 is disposed on the sidewall 111 of the lamp 11 and the connection end 1221 is disposed on the mounting part 121.

Figure 3:
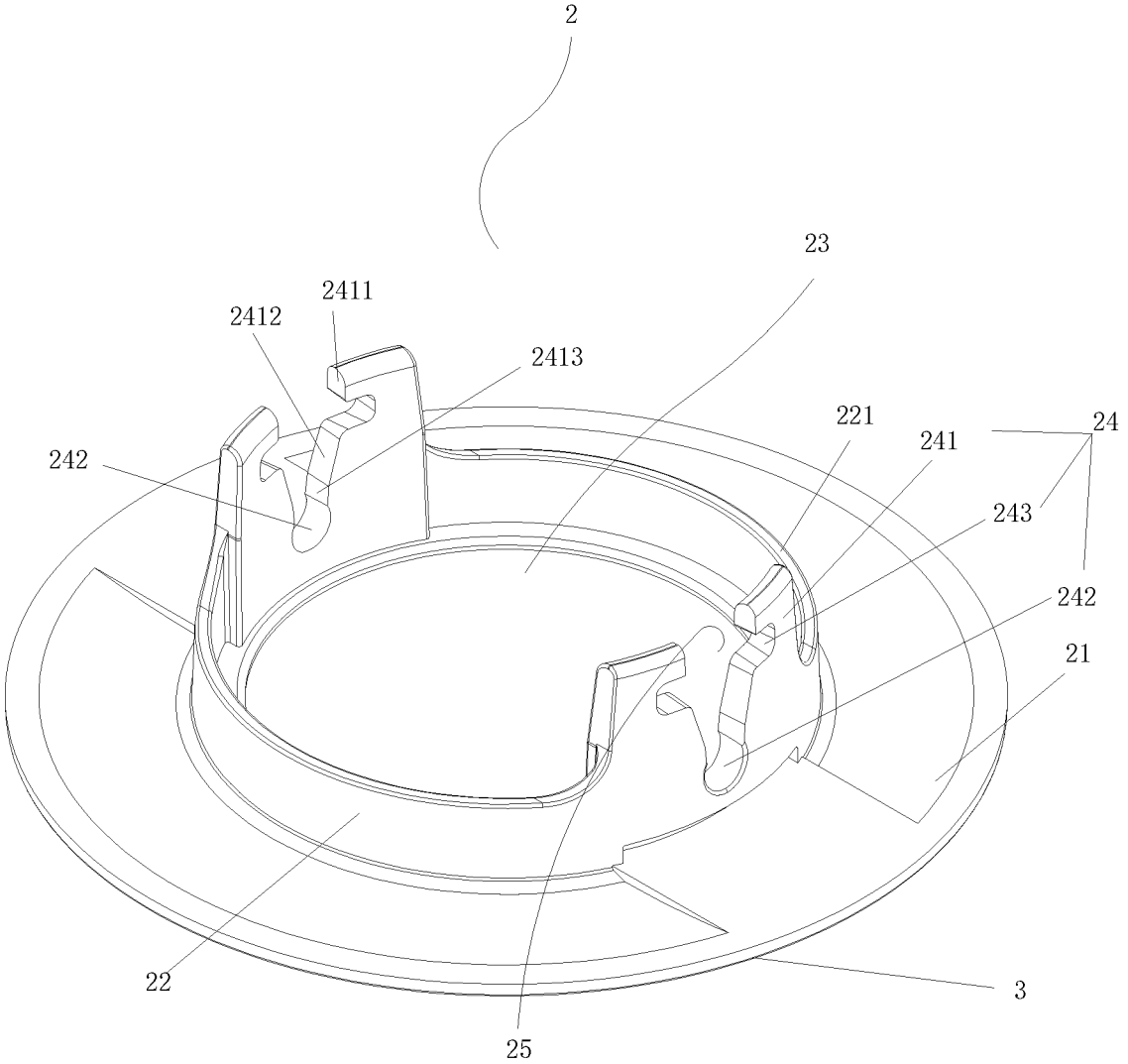
FIG. 3 is a schematic structure diagram of a face ring according to an example of the present disclosure.

In the present disclosure, the rotating shaft 12 having the elastic mechanism 122 is disposed on the lamp 11 and the elastic mechanism 122 is allowed to snap into the face ring 2 as shown in FIG. 3. Thus, the problems of time-consuming locking of screws and failures to fast mounting, dismounting and replacement are solved. Since the elastic mechanism 122 is disposed on the lamp 11, if there is a need for a stabilizing mechanism such as a spring on the face ring 2, the luminaire body 1 does not need to be changed. That is, the luminaire body 1 has good applicability.

In one example of the present disclosure, as shown in FIG. 4 to FIG. 8, the first rabbet 123 is a C-shaped rabbet that forms a groove in the elastic mechanism 122 in the direction away from the connection end 1221. In an embodiment, an open end 1231 of the C-shaped rabbet has a width a of 2±0.2 mm in a direction perpendicular to a direction far away from the connection end 1221. There is a wall thickness b of 1 to 1.2 mm between a proximal end 124 of the outer wall of the elastic mechanism 122 and the closed end 1232 of the C-shaped rabbet. The elastic mechanism 122 has an outer diameter r of 5 to 5.5 mm. A rabbet is a recess or a groove cut into the edge of a part of the luminaire body, and the cross section of a rabbet at least includes an open edge.

Figure 6:
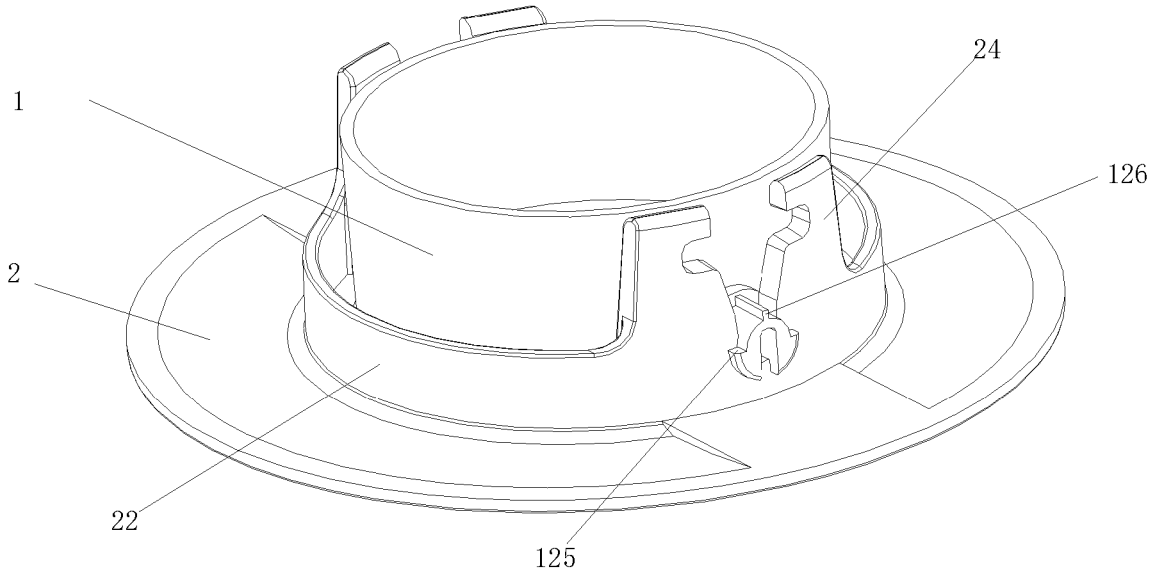
FIG. 6 is a schematic structure diagram of a lighting device according to an example of the present disclosure.
Figure 7:
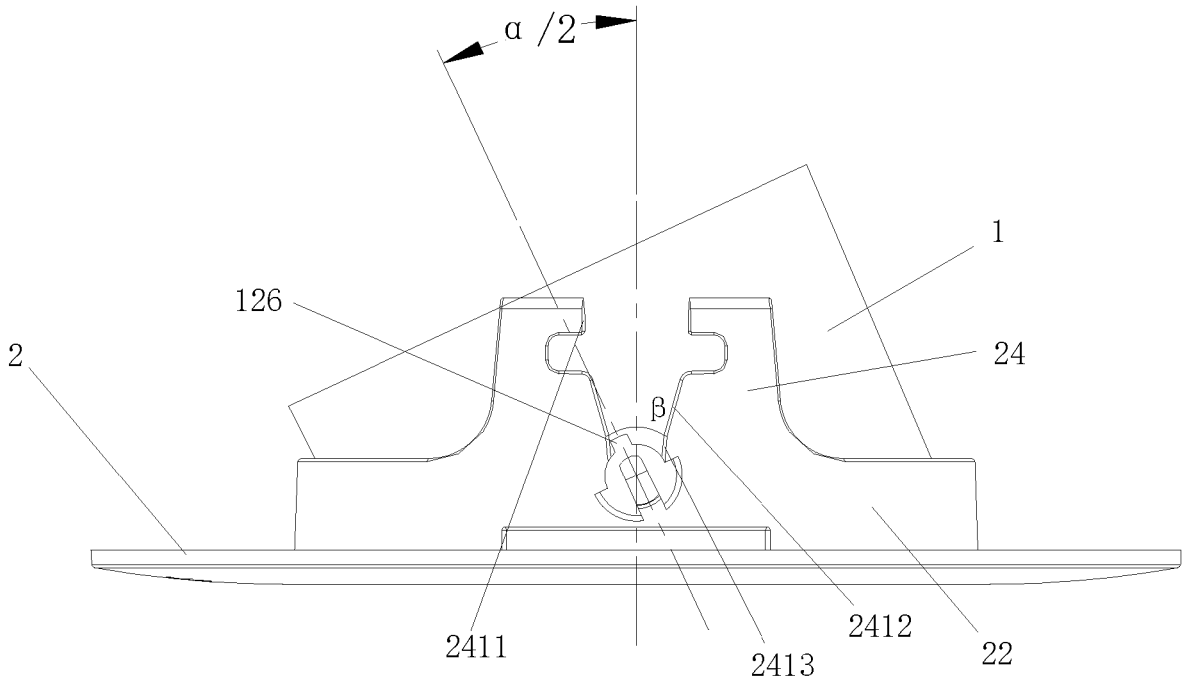
FIG. 7 is a schematic structure diagram of a luminaire body rotated to one side within a face ring.
Figure 8:
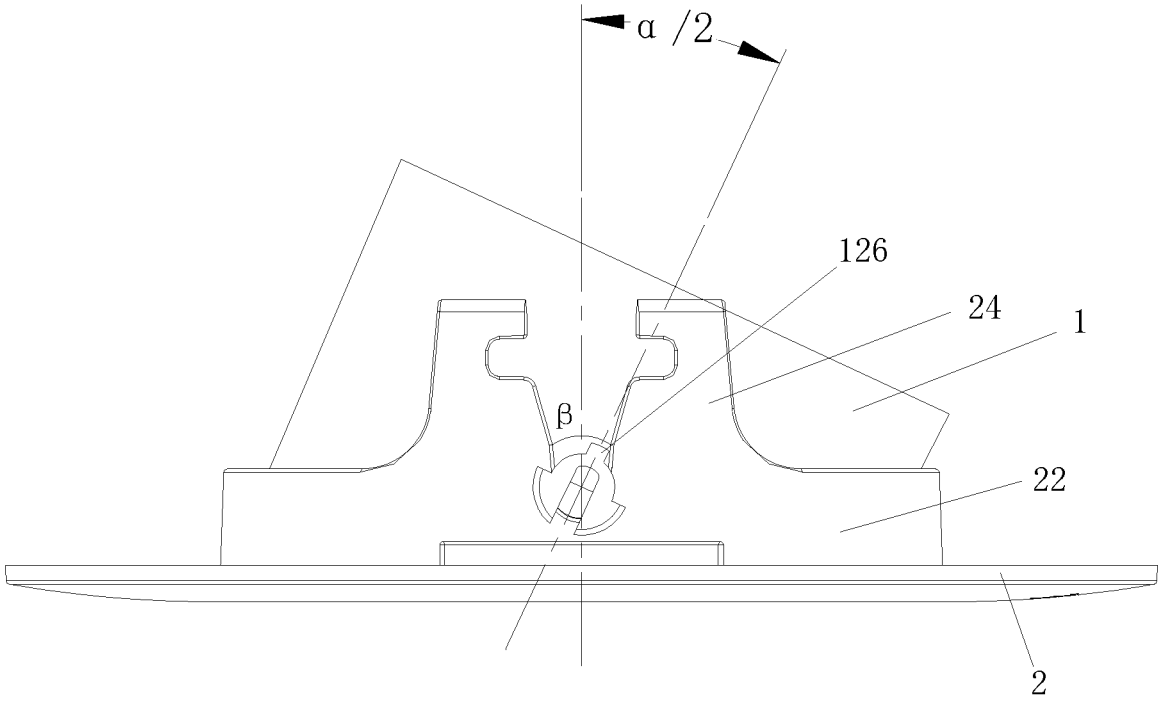
FIG. 8 is a schematic structure diagram of a luminaire body rotated to the other side within a face ring.

In one example of the present disclosure, as shown in FIG. 6 to FIG. 8, a second limiting unit 126 is disposed on the proximal end 124 of the outer wall of the elastic mechanism 122 to limit a rotation angle $\alpha$ of the rotating shaft 12. The rotation angle is typically set within a range of 20 to 35°, and the second limiting unit 126 may change in width with the rotation angle $\alpha$. For example, when the rotation angle is set to 20°, the second limiting unit 126 has a maximum width; and when the rotation angle is set to 35°, the second limiting unit 126 has a minimal width.

Figure 9:
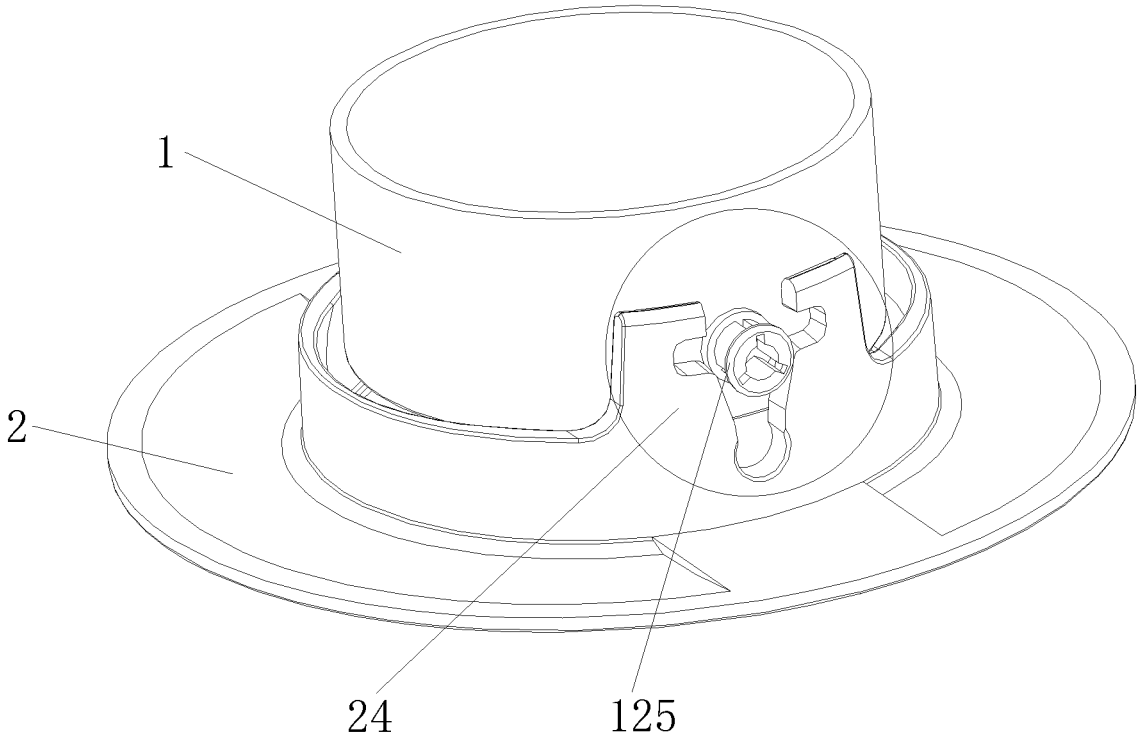
FIG. 9 is a schematic structure diagram of a luminaire body mounted downwardly in a face ring according to another example of the present disclosure.
Figure 10:
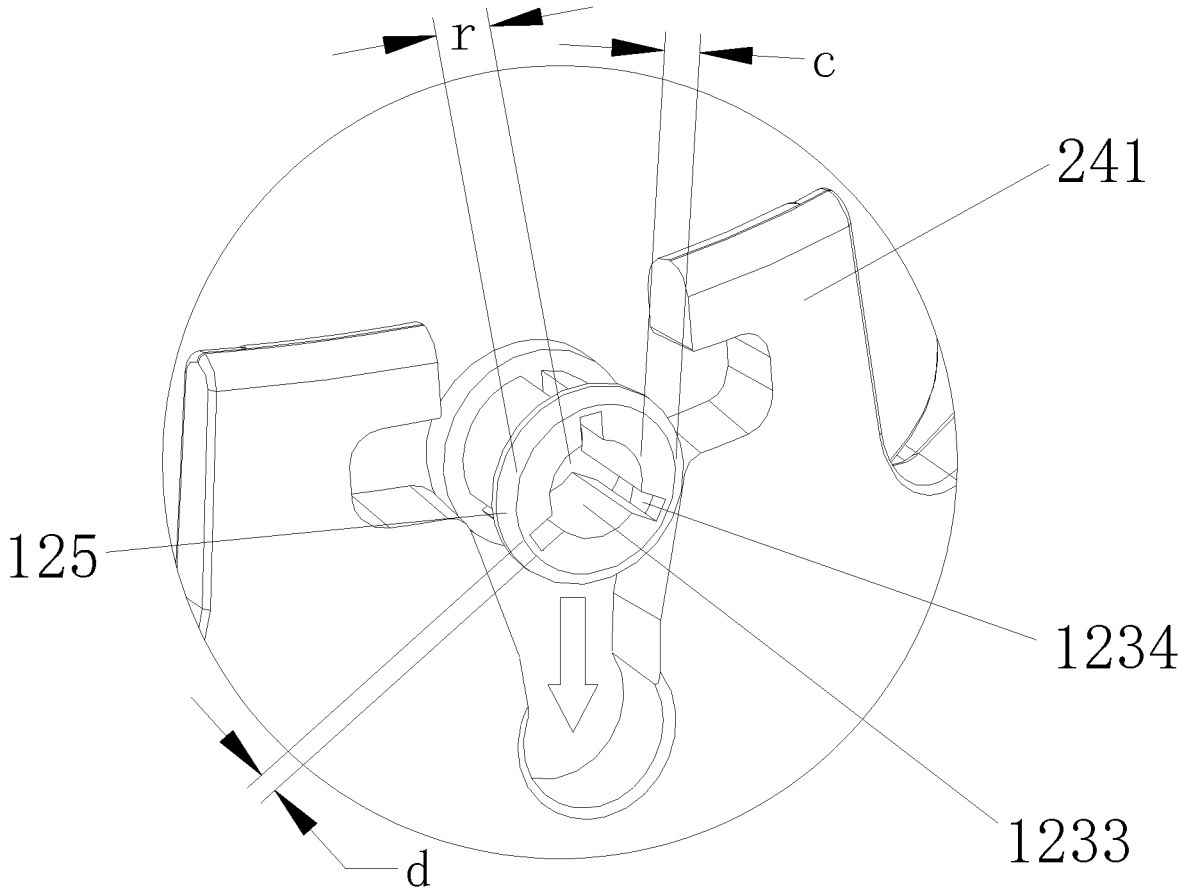
FIG. 10 is a partial structural diagram of FIG. 9.

In another example of the present disclosure, as shown in FIG. 9 to FIG. 10, four first rabbets 123 are provided along a direction away from the sidewall 111 of the lamp 11. A circular rabbet 1233 is formed in the center of the elastic mechanism 122. Three grooves 1234 are formed in a direction from the circular rabbet 1233 toward the outer wall of the elastic mechanism 122. The three grooves 1234 form a Y-shaped rabbet. In an embodiment, there is a wall thickness c of 1 to 1.2 mm between the edge of the circular rabbet 1233 and the proximal end 124 of the outer wall of the elastic mechanism 122. The elastic mechanism 122 has an outer diameter r of 5 to 5.5 mm. The groove 1234 has a width d of 1 to 1.2 mm in a direction perpendicular to a direction far away from the connection end 1221.

In one example of the present disclosure, as shown in FIG. 1, FIG. 2, FIG. 4 and FIG. 6, the luminaire body 1 further includes a first limiting unit 125 disposed at the other end of the elastic mechanism 122. The first limiting unit 125 and the mounting part 121 fit the inner wall and the outer wall of the face ring 2, respectively, and serve for fastening the elastic mechanism 122 to the face ring 2, preventing deformation of the face ring 2 due to an external force when the luminaire body 1 is in contact with the face ring 2.

If the first limiting unit 125 is disposed on the luminaire body 1 having the C-shaped rabbet, the first limiting unit 125 is a fan-shaped mechanism having two ends connected to two ends of the opening of the C-shaped rabbet, respectively.

The first limiting unit 125 is a bump extending in a direction from the end of the C-shaped rabbet to the mounting part 121. In consideration of material saving and cost effectiveness, the fan-shaped mechanism is notched in a direction away from the opening of the C-shaped rabbet. In one example of the present disclosure, as shown in FIG. 1, the fan-shaped mechanism is notched along the outer wall of the rotating shaft 12 so that the first limiting unit 125 is divided into two fan-shaped mechanisms.

As shown in FIG. 9 to FIG. 10, if the first limiting unit 125 is disposed on the luminaire body 1 having the Y-shaped rabbet, the first limiting unit 125 is a circular ring mechanism for being sleeved on the other end of the elastic mechanism 122. An opening in conformance with the Y-shaped rabbet is formed in the circular ring mechanism.

In one example of the present disclosure, two rotating shafts are disposed on the sidewall 111 of the lamp 11 in a 180° axisymmetric manner. Thus, the mounting stability of the luminaire body 1 and the face ring 2 is improved. For the sake of more stable mounting, more than two rotating shafts 2 may be arranged on the sidewall 111 of the lamp 11 in the form of a circular array.

The luminaire body 1 is made of plastics.

To better match the luminaire body 1, as shown in FIG. 3, the preset application provides a face ring 2 having one end to be sleeved on the luminaire body 1 and the other end to be fixed to a mounting face 3. The face ring 2 includes: a face ring body 21 and an inner ring surface 22. The inner ring surface 22 has a circular ring structure protruding from the face ring body 21 in a direction away from the mounting face 3, and the inner ring surface 22 and the face ring body 21 form a holding part 23 for mounting the luminaire body 1. At least one connection unit 24 is disposed on the outer wall of the inner ring surface 22, and the connection unit 24 is connected to the rotating shaft 12. The face ring 2 may have an integrated structure and thus can be produced by a simple process with low cost.

In one example of the present disclosure, the connection unit 24 includes two clamping parts 241 extending along an end face 221 of the inner ring surface 22 in a direction away from the mounting face 3. The two clamping parts 241 and the inner ring surface 22 form a second rabbet 25 which is connected to the rotating shaft 12. The second rabbet 25 is a groove formed between the two clamping parts 241 and the inner ring surface 22, and the second rabbet 25 includes an opening between the two clamping parts 241.

In one example of the present disclosure, an inclined guide face 2412 is formed on an inner wall 2411, on the side fitting the rotating shaft 12, of the clamping part 241; a mating hole 242 is formed in the bottom of the second rabbet 25; and two ends, far away from the mounting face 3, of the mating hole 242 are connected to ends of the two inclined guide faces 2412, respectively. Alternatively, the two ends of the mating hole 242 are connected to the ends of two inclined guide faces 2412 through two transition faces 2413. When mounting the luminaire body 1 on the face ring 2, the luminaire body 1 is pressed towards the mounting face 3. Since the elastic mechanism 122 is deformable, the elastic mechanism 122 is pressed in the mating hole 242 along the inclined guide faces 2412. The elastic mechanism 122 cannot be disengaged from the mating hole 242 without an external force.

In one example of the present disclosure, as shown in FIG. 7 and FIG. 8, an included angle β between the two inclined guide faces 2412 is 30±5°.

In one example of the present disclosure, a length of a circular arc at the opening of the mating hole 242 is smaller than ½ of a circumference of the mating hole. Thus, the size of the opening of the mating hole 242 is smaller than the diameter of the mating hole 242, so that the mating hole 242 plays a role in holding down the elastic mechanism 122, allowing the elastic mechanism 122 to be arranged in the mating hole 242 more stably.

In one example of the present disclosure, spring mounting grooves 243 are formed between the ends of the two inclined guide faces 2412 and the top ends of the clamping parts 241 in a direction far away from the mounting face 3.

The face ring 2 may be made of a metal material or plastics.

Figure 4:
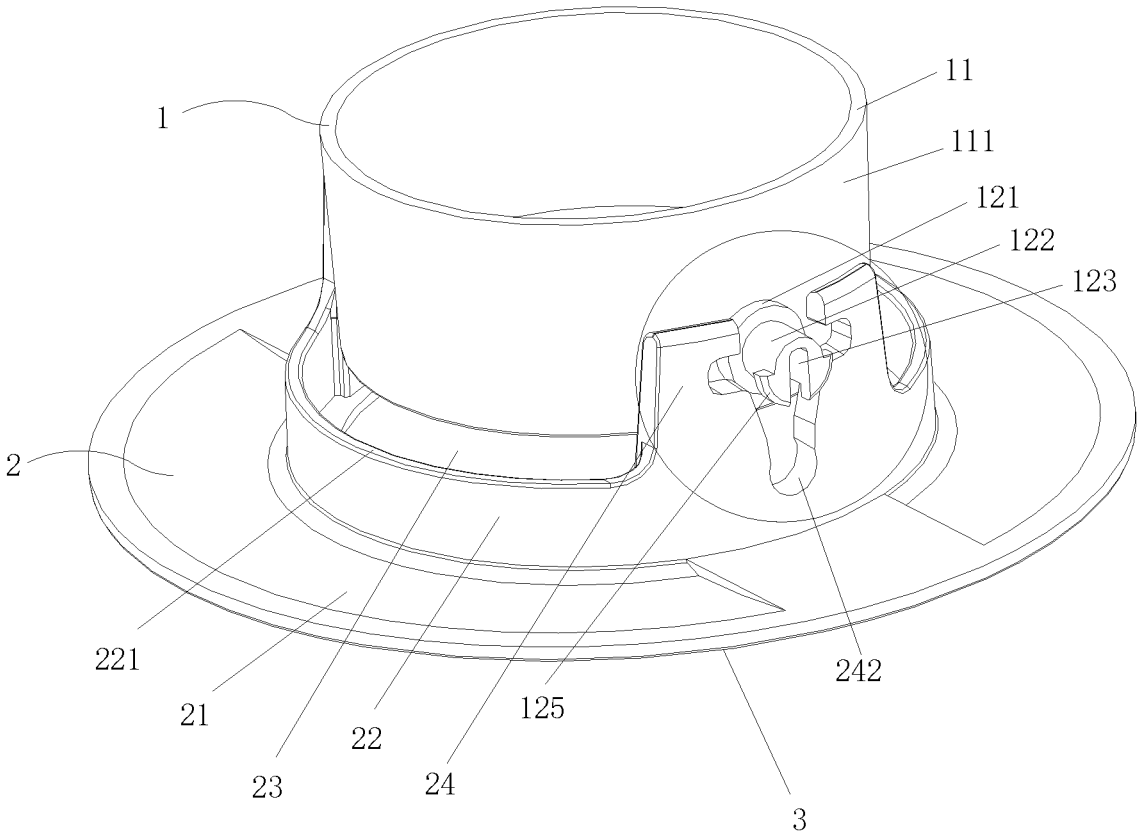
FIG. 4 is a schematic structure diagram of a luminaire body mounted downwardly in a face ring according to an example of the present disclosure.
Figure 5:
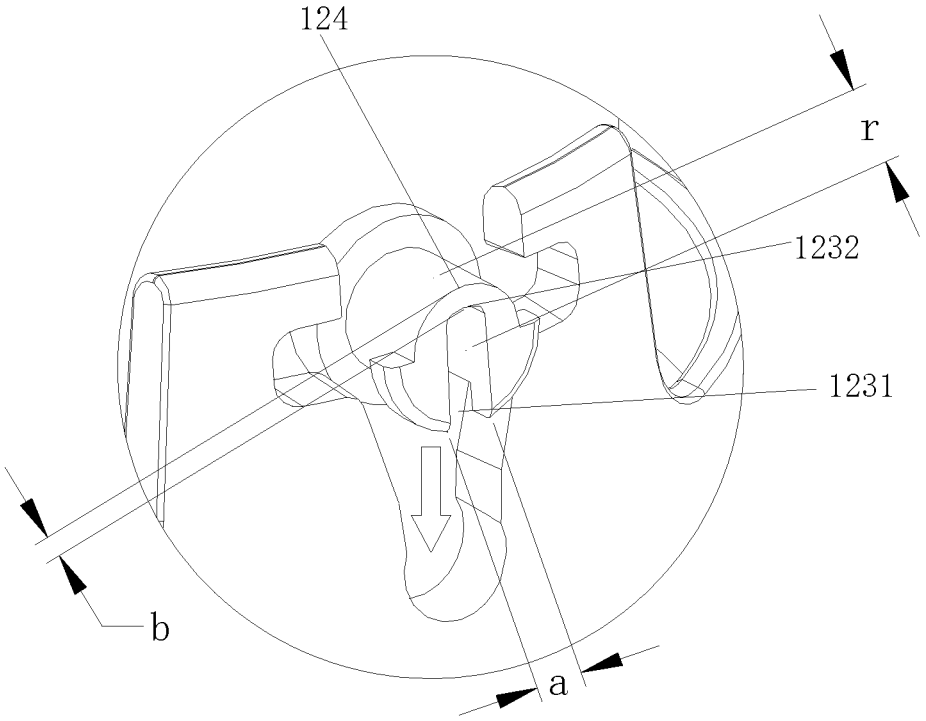
FIG. 5 is a partial structure diagram of FIG. 4.

As shown in FIG. 4, FIG. 6 and FIG. 9, the present disclosure provides a lighting device includes a luminaire body 1, and a face ring 2 attachable to the luminaire body 1.

In one example of the present disclosure, when the face ring 2 is sleeved on the outer side of the luminaire body 1, the mounting part 121 of the luminaire body 1 fits an inner wall of the inner ring surface 22, while the first limiting unit 125 of the luminaire body 1 fits an outer wall of the inner ring surface 22; and the elastic mechanism 122 is arranged in the mating hole 242. When mounting the luminaire body 1 on the face ring 2, the elastic mechanism 122 is pressed between the clamping parts 241 of the face ring 2 under the action of an external force. The elastic mechanism 122 will undergo a deformation under the action of the clamping parts 241, and thus may be clamped by the clamping parts 241, so that the face ring 2 is sleeved on the sidewall 111 of the lamp 11, thereby achieving rapid connection of the face ring 2 and the luminaire body 1. When removing the face ring 2 from the luminaire body 1, the rotating shaft 12 is disengaged from the clamping parts 241 under the action of an external force, thereby achieving rapid dismounting of the face ring 2 from luminaire body 1.

The luminaire body disclosed in this example of the present disclosure includes a lamp, and at least one rotating shaft disposed on the sidewall of the lamp. When mounting the luminaire body on the face ring, the elastic mechanism is pressed between the clamping parts of the face ring under the action of an external force. The elastic mechanism will undergo a deformation under the action of the clamping parts, and thus may be clamped by the clamping parts, so that the face ring is sleeved on the sidewall of the lamp, thereby achieving rapid connection of the face ring and the luminaire body. When removing the face ring from the luminaire body, the rotating shaft is disengaged from the clamping parts under the action of an external force, thereby achieving rapid dismounting of the face ring from luminaire body.

One example of the present disclosure discloses a lamp housing assembly. As shown in FIG. 11 to FIG. 14, the lamp housing assembly includes a face ring 20 and a housing 10. The face ring 20 has a first mounting space 210 therein. Two first sliding faces 230 are formed opposite to each other on an outer surface of the face ring 20. A second mounting space 220 is formed on the first sliding face 23. The housing 10 is disposed in the first mounting space 210. Two rotating shafts 1220 are connected to the housing 10, and each rotating shaft 1220 is in running fit with the corresponding second mounting space 22. An adjusting block 1210 is disposed on the rotating shaft 122. The adjusting block 1210 presses against the corresponding first sliding face 23.

The lamp housing assembly provided in this example has the following advantages: when there is a need to adjust the angle of the housing 10, the housing 10 may be rotated, causing the adjusting blocks 1210 to rotate relative to the first sliding faces 23. When the irradiation angle is adjusted to an appropriate angle, the housing 10 is released. Due to the elasticity of an elastic body 12, the adjusting blocks 1210 are caused to press against the first sliding faces 23, and there is a damping force between each adjusting block and each first sliding face 23, which keeps the housing 10 in the adjusted position after the housing 10 is released. The lamp housing assembly provided in this example permits the adjustment of the angle of the housing 10 based on the running fit between the adjusting blocks 1210 and the first sliding faces 230 and the damping force between the adjusting blocks 1210 and the first sliding faces 23. In addition, there is no limitation on the material of the face ring 20. The face ring 20 may be made of an elastic material, or a hard material such as a metal.

Figure 11:
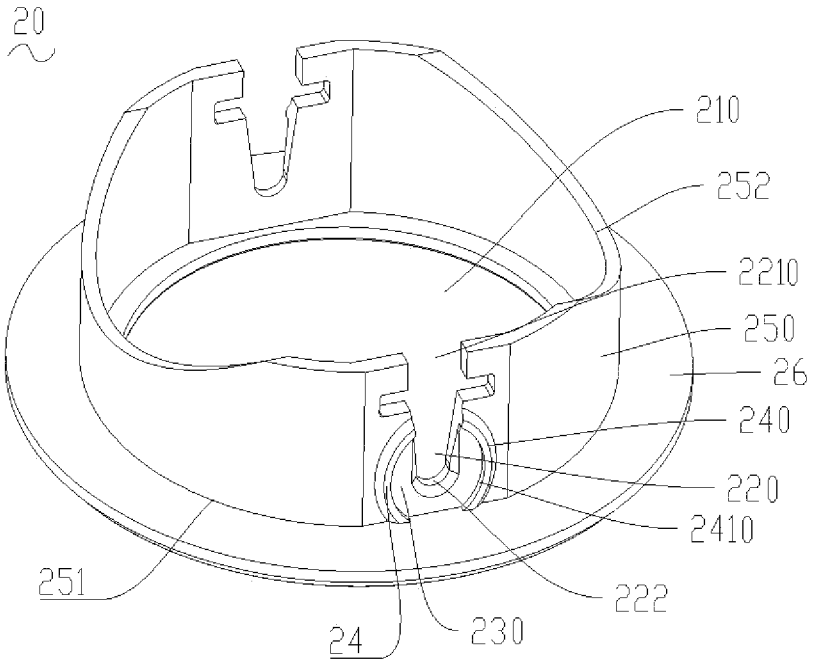
FIG. 11 is a stereogram of a face ring according to an example of the present disclosure.
Figure 12:
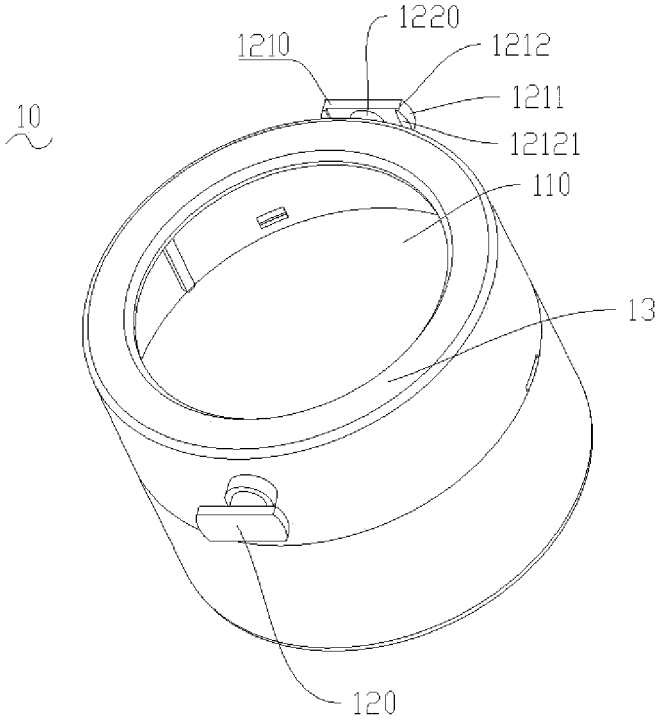
FIG. 12 is an internal view of a housing according to an example of the present disclosure.
Figure 13:
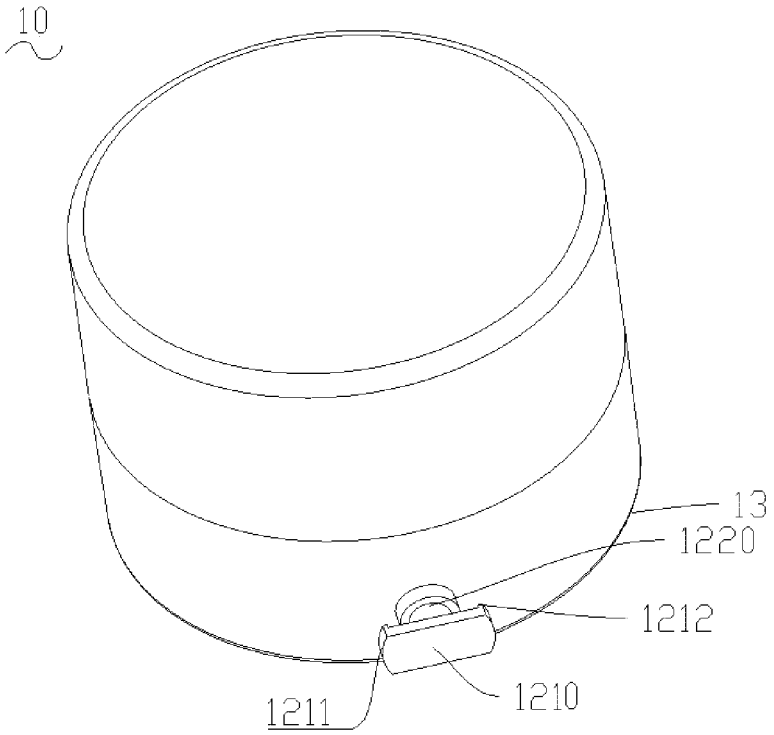
FIG. 13 is an external view of a housing according to an example of the present disclosure.
Figure 14:
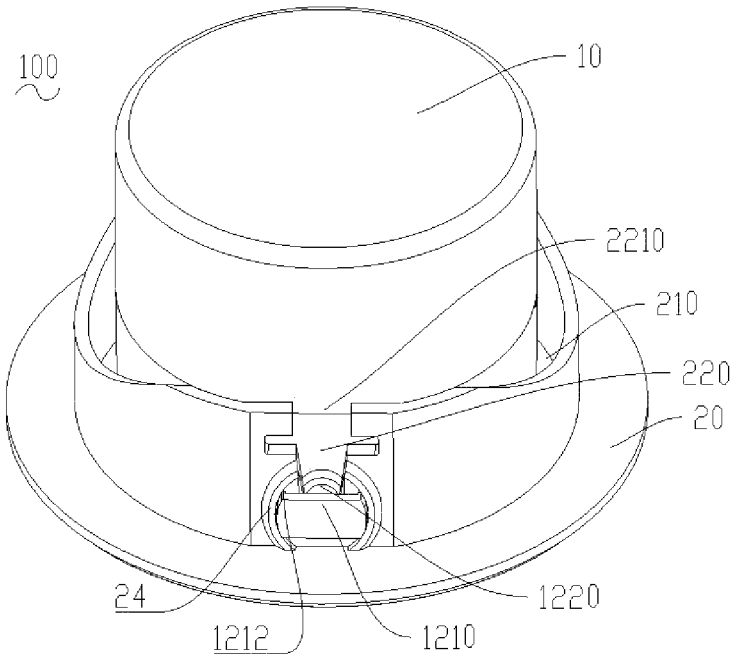
FIG. 14 is a stereogram of a spot lamp according to another example of the present disclosure.

As shown in FIG. 11, the face ring 20 includes a tubular body 250 and an annular body 26. The tubular body 250 is connected to the annular body 26, and the inner cavity of the tubular body 250 and a central hole of the annular body 26 define a first mounting space 210 passing through the face ring 20. Two first sliding faces 230 are formed on the outer surface of the tubular body 250. A second mounting space 220 is formed on each of the two first sliding faces 23. The housing 10 has a mounting cavity 110 therein. The mounting cavity 110 is used for mounting a light-emitting assembly. The housing 10 is disposed in the first mounting space 210.

The rotating shaft 1220 and the adjusting block 1210 form an elastic body 12. Two elastic bodies 120 are connected to the outer surface of the housing 10. The rotating shaft 1220 is in running fit with the second mounting space 22. An inner end of the rotating shaft 1220 extends through the second mounting space 220 to be connected to the housing 10. The adjusting block 1210 is disposed at an outer end of the rotating shaft 122.

The elastic body 120 may include the rotating shaft 122, the adjusting block 1210 and a spring such that the adjusting block 1210 can elastically press against the first sliding face 23. With the combination of the rotating shaft 122, the adjusting block 1210 and the spring, the adjusting block 1210 is allowed to elastically press against the first sliding face 23. The elastic body 120 may also be made, in part, of an elastic material, thus allowing the adjusting block 1210 to elastically press against the first sliding face 23. For example, the rotating shaft 1220 is made of an elastic material, while the adjusting block 1210 is made of a non-elastic material. Since the rotating shaft 1220 needs to be in running fit with the second mounting space 22, the rotating shaft 1220 is required to have rigidity and elasticity. Alternatively, the adjusting block 1210 is made of an elastic material, while the rotating shaft 1220 is made of a non-elastic material. In an embodiment, the elastic body 120 in this example is entirely made of an elastic material. That is, both of the rotating shaft 1220 and the adjusting block 1210 are made of an elastic material, allowing the elastic body 120 in this example to be molded integrally and thus reducing the steps and cost of assembling. To further reduce the steps and cost of assembling, the elastic body 120 in this example and the housing 10 are integrally formed by injection molding, Since plastics have rigidity and elasticity, the elastic body 120 is endowed with rigidity and elasticity, allowing the rotating shaft 1220 to be in running fit with the second mounting space 220 and the adjusting block 1210 to press against the first sliding face 23.

The first sliding face 230 may be a circular-arc-shaped face. During the rotation of the rotating shaft 122, the adjusting block 1210 is capable of rotating on the first sliding face 230 because the elastic body 120 has elasticity. To allow the adjusting block 1210 to rotate more smoothly on the first sliding face 23, in an embodiment, the first sliding face 230 in this example is a flat face which is easy to manufacture. Further, to allow the adjusting block 1210 to rotate more smoothly on the first sliding face 23, in this example, the face, oriented toward the first sliding face 23, of the adjusting block 1210 is also formed into a flat face, i.e., the face, to be in running fit with the first sliding face 23, of the adjusting block 1210 is also formed into a flat face. To enable two flat faces to press against each other and rotate relative to each other, there is a high requirement on the surface accuracy of the two flat faces. To meet the high surface accuracy requirement, more steps and more cost are needed. To reduce the manufacturing steps and cut down the cost in this example, the area of the running fit faces between the first sliding face 230 and the adjusting block 1210 needs to be reduced, so that the friction between the two faces in running fit with each other is reduced and the requirement on the surface accuracy of the faces is lowered. In addition, since the adjusting block 1210 needs to be limited on the first sliding face 230 by the second mounting space 22, the adjusting block 1210 cannot be small in size.

In an embodiment, a protrusion 1212 is formed on the face, oriented toward the housing 10, of the adjusting block 1210 in this example. The face, oriented toward the housing 10, of the protrusion 1212 is a second sliding face 12121. The second sliding face 12121 is in running fit with the first sliding face 23. In this example, forming the protrusion 1212 on the face, oriented toward the housing 10, of the adjusting block 1210 and forming the second sliding face 12121 on the protrusion 1212 may produce the following beneficial effects: 1, the area of the second sliding face 12121 may be small to reduce the friction between the second sliding face 12121 and the first sliding face 23, allowing the second sliding face 12121 and the first sliding face 230 to abut against each other and to rotate relative to each other without getting stuck. 2. The adjusting block 1210 can be limited on the first sliding face 230 by the second mounting space 220 without being reduced in size.

The elastic body 120 in this example may be connected to the housing 10 by means of a connecting piece, or may be integrated with the housing 10. The second mounting space 220 formed on the first sliding face 230 may be of a closed hole structure, or may be of a groove structure with an open end.

When the second mounting space 220 is of the hole structure, it is required that the adjusting block 1210 has a greater size than the second mounting space 220 because the adjusting block 1210 needs to be limited on the first sliding face 230 by the second mounting space 22. That is, the adjusting block 1210 cannot pass through the second mounting space 22. In this case, the elastic body 120 cannot be integrated with the housing 10. In other words, when the second mounting space 220 is of the hole structure, the elastic body 120 is assembled with the housing 10 by means of a connecting piece.

When the second mounting space 220 is of the groove structure, the elastic body 120 may be connected to the housing 10 by means of a connecting piece, or may be integrated with the housing 10. In an embodiment, the second mounting space 220 in this example is of the groove structure. Specifically, the tubular body 250 includes a first tubular end 251 and a second tubular end 252. The first tubular end 251 is connected to the annular body 26. The second mounting space 220 includes a first end 2210 and a second end 222. The first end 2210, which is an open end, is located on the second tubular end 252, while the second end 222, which is a closed end, is located between the first tubular end 251 and the second tubular end 252. The housing 10 is moved from the second tubular end 252 toward the first tubular end 251 to be mounted in the first mounting space 210 of the face ring 20.

As shown in FIG. 11, the second mounting space 220 is arranged along an axis of the face ring 20. To save the material of the adjusting block 121, the length direction of the adjusting block 1210 in this example is perpendicular to the axis of the face ring 20. Thus, the adjusting block 1210 can be limited by the second mounting space 220 with a small size, and the material of the adjusting block 1210 is saved.

The second mounting space 220 in this example may be the same or different in size from the first end 2210 to the second end 222 as long as it can receive the middle portion of the rotating shaft 1220 and limit the adjusting block 121. In an embodiment, for the convenience of mounting the housing 10 on the face ring 20, the second mounting space 220 in this example is gradually reduced in size in a direction from the first end 2210 to the second end 222 to form a guide structure that facilitates the entry of the rotating shaft 1220 into the second mounting space 22.

After the housing 10 is mounted in the first mounting space 210 of the face ring 20, the rotating shaft 1220 is supported by the second end 222 of the second mounting space 22. To facilitate the rotation of the second end 222 and the rotating shaft 1220 relative to each other, in an embodiment, the surface of the second end 222 in this example is a circular-arc-shaped surface. The rotating shaft 1220 is in running fit with the second end 222. The rotating shaft 122, the adjusting block 1210 and the housing 10 are integrally formed by injection molding.

To guide the rotation of the adjusting block 121, a guide block 240 is disposed on the first sliding face 230 in this example. The face, oriented toward the second mounting space 22, of the guide block 24, is a first guide face 241, while the face, opposite to the first guide face 241, of the adjusting block 1210 is a second guide face 1211. Both of the first guide face 2410 and the second guide face 1211 are circular-arc-shaped faces. The first guide face 2410 is in sliding fit with the second guide face 1211.

One or two guide blocks 240 may be used. In case of one guide block 24, the effect of guiding the rotation of the adjusting block 1210 can still be achieved. To further enhance the guiding effect, two guide blocks 240 are used in this example, which are located oppositely on two sides of the second mounting space 22, respectively. Correspondingly, the faces, opposite to two first guide faces 241, of the adjusting block 1210 are both second guide faces 1211.

With the protrusion 1212 on the face, oriented toward the housing 10, of the adjusting block 1210, each of the guide block 240 and the adjusting block 1210 is required to have a great thickness so as to ensure a large area of fit between the first guide face 2410 of the guide block 240 and the second guide face 1211 of the adjusting block 121, thus resulting in increased cost. To save the cost, in an embodiment, the end, oriented toward the first guide face 241, of the adjusting block 1210 is an outer end, and the protrusion 1212 is disposed on the outer end of the adjusting block 121. Thus, the face, oriented toward the first guide face 241, of the protrusion 1212 forms part or all of the second guide face 1211. To provide a large area of fit between the first guide face 2410 of the guide block 240 and the second guide face 1211 of the adjusting block 121, the face, oriented toward the first guide face 241, of the protrusion 1212 forms part of the second guide face 1211. The rotating shaft 122, the adjusting block 121, the protrusion 1212 and the housing 10 are integrally formed by injection molding.

As shown in FIG. 11 to FIG. 14, an example of the present disclosure discloses a spot lamp 100. The spot lamp 100 includes a light-emitting assembly and the lamp housing assembly as described above. The light-emitting assembly includes a lamp. The light-emitting assembly is mounted in the mounting cavity 11. The annular body 26 is located at a light-exiting end of the light-emitting assembly.

The housing 10 has a housing mounting end 13 which is open and communicated with the mounting cavity 11. The light-emitting assembly is mounted in the mounting cavity 110 via the housing mounting end 13, and the lamp is disposed at the housing mounting end 13. The housing mounting end 13 is the light-exiting side.

After the housing 10 is assembled with the face ring 20, the housing 10 is capable of rotating in the first mounting space 210 of the face ring 20. Since the first mounting space 210 extends through the face ring 20, the illumination of the lamp would not be blocked. The end, connected to the tubular body 250, of the annular body 26 is a first annular end, while the other end thereof is a second annular end. Light emitted by the lamp goes out from the center of the second annular end of the annular body 26.

The spot lamp 100 in this example has the following advantages: when there is a need to adjust the irradiation angle of the spot lamp 100, the housing 10 may be rotated, causing the adjusting blocks 1210 to rotate relative to the first sliding faces 23. When the irradiation angle is adjusted to an appropriate angle, the housing 10 is released. In this case, the adjusting blocks 1210 are caused to press against the first sliding faces 23, and there is a damping force between the adjusting block and the first sliding face 23. The damping force can keep the irradiation angle of the spot lamp 100 in the adjusted position after the housing 10 is released. The spot lamp 100 in this example permits the adjustment of the irradiating angle of the spot lamp 100 based on the running fit between the adjusting blocks 1210 and the first sliding faces 230 and the damping force between the adjusting blocks 1210 and the first sliding faces 23. In addition, there is no limitation on the material of the face ring 20. The face ring 20 may be made of an elastic material, or a hard material such as a metal.

For the spot lamp 100 mounting on a ceiling, during the mounting, the entire spot lamp 100 can be mounted on the ceiling by mounting the face ring 20 on the ceiling.

The spot lamp provided in the present disclosure has the following advantages: when there is a need to adjust the irradiation angle of the spot lamp, the housing may be rotated, causing the adjusting blocks to rotate relative to the first sliding faces. When the irradiation angle is adjusted to an appropriate angle, the housing is released. In this case, the adjusting blocks are caused to press against the first sliding faces, thereby inducing a damping force between the adjusting blocks and the first sliding faces. The damping force can keep the irradiation angle of the spot lamp in the adjusted position after the housing is released. The spot lamp provided in the present disclosure permits the adjustment of the irradiating angle of the spot lamp based on the running fit between the adjusting blocks and the first sliding faces and the damping force between the adjusting blocks and the first sliding faces. In addition, there is no limitation on the material of the face ring. The face ring may be made of an elastic material, or a hard material such as a metal.

The present disclosure provides following examples.

In a first aspect, an example of the present disclosure provides a luminaire body, including: a lamp, and at least one rotating shaft disposed on a sidewall of the lamp. One end of the elastic mechanism serves as a connection end which is disposed on the sidewall of the lamp. At least one first rabbet is provided in the elastic mechanism in a direction away from the connection end.

In a second aspect, the present disclosure provides a face ring having one end configured to be sleeved on the luminaire body as described above and the other end configured to be fixed to a mounting face. The face ring includes: a face ring body and an inner ring surface. The inner ring surface has a circular ring structure protruding from the face ring body in a direction away from the mounting face, and the inner ring surface and the face ring body form a holding part for mounting the luminaire body. At least one connection unit is disposed on an outer wall of the inner ring surface, and the connection unit is configured to be connected to the rotating shaft.

In a third aspect, the present disclosure provides a lighting device including the luminaire body as described above, and the above-described face ring which is attachable to the luminaire body.

In a fourth aspect, the present disclosure provides a lamp housing assembly including: a face ring having a first mounting space therein, two first sliding faces are formed opposite to each other on an outer surface of the face ring, and a second mounting space is provided on the first sliding face; and a housing disposed in the first mounting space. Two rotating shafts connected to the housing, and each rotating shaft is in running fit with the corresponding second mounting space. An adjusting block is disposed on each of the rotating shafts. The adjusting block presses against the corresponding first sliding face.

In a fifth aspect, the present disclosure provides a spot lamp including a light-emitting assembly and the above-described lamp-housing assembly. The light-emitting assembly includes a lamp and is mounted in the mounting cavity.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The foregoing description of each example of the present disclosure focuses on the differences from other example. Different optimized features of various examples can be combined to derive a better example as long as they do not contradict each other, which will not be reiterated here in consideration of simplicity of wording.

The foregoing is merely illustrative of the examples of the present disclosure and is not intended to limit the present disclosure. Various changes and modifications can be made to the present disclosure by those skilled in the art. Any modifications, equivalent substitutions, improvements or the like made within the spirit and principle of the present disclosure shall be encompassed into the protection scope of the present disclosure.

The invention claimed is:

1. A luminaire body, comprising: a lamp, and at least one rotating shaft disposed on a sidewall of the lamp, wherein:

the rotating shaft comprises an elastic mechanism;

a first end of the elastic mechanism serves as a connection end which is disposed on the sidewall of the lamp; and at least one first rabbet is formed in the elastic mechanism at a second end of the elastic mechanism in a direction away from the connection end, and a first limiting unit is disposed at the second end of the elastic mechanism.

2. The luminaire body according to claim 1, wherein the rotating shaft further comprises: a mounting part disposed on the sidewall of the lamp, the connection end is disposed on the mounting part.

3. The luminaire body according to claim 1, wherein the first rabbet is a C-shaped rabbet.

4. The luminaire body according to claim 1, wherein: four first rabbets are provided in a direction away from the sidewall of the lamp; a circular rabbet is formed in a center of the elastic mechanism; three grooves are provided in a direction from the circular rabbet toward an outer wall of the elastic mechanism; and the three grooves form a Y-shaped rabbet.

5. The luminaire body according to claim 1, wherein:

two rotating shafts disposed on the sidewall of the lamp in a 180° axisymmetric manner.

6. A face ring comprising one end configured to be sleeved on a luminaire body, wherein:

the luminaire body comprises a lamp, and at least one rotating shaft disposed on a sidewall of the luminaire body, the rotating shaft comprises an elastic mechanism, a first end of the elastic mechanism serves as a connection end which is disposed on the sidewall of the luminaire body, and at least one first rabbet is formed in the elastic mechanism at a second end of the elastic mechanism in a direction away from the connection end, and a first limiting unit is disposed at the second end of the elastic mechanism; and another end of face ring is configured to be fixed to a mounting face, and the face ring comprises: a face ring body and an inner ring surface, and the inner ring surface has a circular ring structure protruding from the face ring body in a direction away from the mounting face, and the inner ring surface and the face ring body form a holding part for mounting the luminaire body; at least one connection unit is disposed on an outer wall of the inner ring surface, and the connection unit is configured to be connected to the rotating shaft.

7. The face ring according to claim 6, wherein the connection unit comprises two clamping parts extending from an end face of the inner ring surface in a direction away from the mounting face; the two clamping parts and the inner ring surface form a second rabbet and the rotating shaft is connected to the second rabbet; inclined guide faces are provided on an inner wall, on the side fitting the rotating shaft, of the clamping part; a mating hole is formed in the bottom of the second rabbet.

8. The face ring according to claim 7, wherein an included angle between the two inclined guide faces is 30±5°, a length of a circular arc at the opening of the mating hole is smaller than ½ of a circumference of the mating hole, and spring mounting grooves are formed between the ends of the two inclined guide faces and top ends of the clamping parts in a direction far away from the mounting face.

9. The face ring according to claim 6, wherein the face ring is a part of a lighting device which comprises the luminaire body, and the face ring is attachable to the luminaire body.

10. The face ring according to claim 9, wherein, upon the face ring being sleeved on an outer side of the luminaire body, the luminaire body fits an inner wall of the inner ring surface, and the first limiting unit of the luminaire body fits an outer wall of the inner ring surface;

and the elastic mechanism is arranged in the mating hole.

11. A lamp housing assembly, comprising:

a face ring having a first mounting space therein, wherein two first sliding faces are formed opposite to each other on an outer surface of the face ring, and a second mounting space is provided on the first sliding face; and a housing disposed in the first mounting space, wherein two rotating shafts are connected to the housing, and each rotating shaft is rotatably connected with the corresponding second mounting space; an adjusting block is disposed on each of the rotating shafts; the adjusting block presses against the corresponding first sliding face, and a guide block is disposed on the first sliding face to guide rotation of the adjusting block.

12. The lamp housing assembly according to claim 11, wherein the first sliding face is a flat face, the rotating shafts and the adjusting blocks are made of an elastic material, and the face ring comprises a first tubular end and a second tubular end; the second mounting space comprises a first end which is an open end and located on the second tubular end, and a second end which is a closed end; and the rotating shaft is rotatably connected with the second end.

13. The lamp housing assembly according to claim 12, wherein a surface of the second end is a circular-arc-shaped surface, and the second mounting space is gradually reduced in size in a direction from the first end to the second end.

14. The lamp housing assembly according to claim 11, wherein the rotating shaft, the adjusting block and the housing are integrally formed by injection molding.

15. The lamp housing assembly according to claim 11, wherein a length direction of the adjusting block is perpendicular to an axis of the face ring.

16. The lamp housing assembly according to claim 11, wherein the adjusting block comprises a face that is oriented toward the housing, and a protrusion is on the face of the adjusting block; and wherein a face of the protrusion that is oriented toward the housing is a second sliding face; and the second sliding face rotatably connected with the first sliding face.

17. The lamp housing assembly according to claim 16, wherein a face, oriented toward the second mounting space, of the guide block, is a first guide face, and a face, opposite to the first guide face, of the adjusting block is a second guide face; and both of the first guide face and the second guide face are circular-arc-shaped faces; and the first guide face is in sliding fit with the second guide face.

18. The lamp housing assembly according to claim 17, wherein two guide blocks are provided, the two guide blocks are located oppositely on two sides of the second mounting space.

19. The lamp housing assembly according claim 17, wherein an end, oriented toward the first guide face, of the adjusting block is an outer end, and the protrusion is disposed on the outer end of the adjusting block.

20. The lamp housing assembly according claim 17, wherein the lamp housing assembly is a part of a spot lamp which comprises a light-emitting assembly, and the light-emitting assembly comprises a lamp and is mounted in a mounting cavity.

* * * * *